US012685348B2

(12) United States Patent
Morris et al.

(10) Patent No.: US 12,685,348 B2
(45) Date of Patent: Jul. 21, 2026

(54) DEVICE AND METHOD FOR THE APPLICATION OF EVAPORATION ELEMENTS AND MATERIALS TO GARMENTS AND HEAD GEAR TO REDUCE CORE BODY TEMPERATURE FOR ATHLETIC PERFORMANCE ENHANCEMENT

(71) Applicant: Functional Technology LLC, Baltimore, MD (US)

(72) Inventors: Shane G. W. Morris, Baltimore, MD (US); Lance B. Morris, Baltimore, MD (US); Reid A. Morris, Baltimore, MD (US)

(73) Assignee: Functional Technology LLC, Baltimore, MD (US)

( * ) Notice: Subject to any disclaimer, the term of this patent is extended or adjusted under 35 U.S.C. 154(b) by 0 days.

(21) Appl. No.: 18/902,680

(22) Filed: Sep. 30, 2024

(65) Prior Publication Data

US 2025/0318591 A1 Oct. 16, 2025

Related U.S. Application Data

(63) Continuation of application No. 18/631,386, filed on Apr. 10, 2024, now Pat. No. 12,102,144.

(51) Int. Cl.
*A41D 13/005* (2006.01)
*F24F 5/00* (2006.01)

(52) U.S. Cl.
CPC ..... *A41D 13/0056* (2013.01); *F24F 5/0035* (2013.01); *F24F 2221/12* (2013.01); *F25D 2400/26* (2013.01)

(58) Field of Classification Search
CPC ..... F24F 5/0035; F24F 2221/12; A41D 13/0056; F25D 2400/26; F25D 3/08; F25D 7/00
See application file for complete search history.

(56) References Cited

U.S. PATENT DOCUMENTS

| | | | | |
|---|---|---|---|---|
| 7,721,349 | B1 * | 5/2010 | Strauss | A43B 3/34 450/38 |
| 9,301,557 | B1 | 4/2016 | Santos | |
| 9,635,889 | B1 | 5/2017 | Copeland et al. | |
| 10,820,652 | B2 | 11/2020 | Schlam et al. | |
| 10,973,275 | B2 | 4/2021 | Ulmer et al. | |
| 2001/0000849 | A1 | 5/2001 | Siman-Tov et al. | |

(Continued)

FOREIGN PATENT DOCUMENTS

| | | |
|---|---|---|
| CN | 207202105 U | 4/2018 |
| CN | 207590105 U | 7/2018 |

(Continued)

*Primary Examiner* — Joseph F Trpisovsky
(74) *Attorney, Agent, or Firm* — Berg Hill Greenleaf Ruscitti LLP

(57) ABSTRACT

Described herein is a perspiration evaporation device (PED) utilizing an evaporative column having an internal channel that can be secured to a garment or other accessory. As air passes over the top opening internal channel the internal air pressure within the evaporative column is reduced causing evaporated moisture from a user's skin to be drawn up the internal channel and away from the skin resulting in improved evaporation of moisture and a reduction in the core body temperature of a user.

14 Claims, 11 Drawing Sheets

(56) References Cited

U.S. PATENT DOCUMENTS

| | | | |
|---|---|---|---|
| 2012/0137411 | A1 | 6/2012 | Majoros |
| 2016/0030234 | A1 | 2/2016 | Lofy et al. |
| 2017/0023267 | A1 | 1/2017 | Strauss |

FOREIGN PATENT DOCUMENTS

| | | | |
|---|---|---|---|
| CN | 209769088 | U | 12/2019 |
| CN | 211021033 | U | 7/2020 |
| CN | 213604456 | U | 7/2021 |
| ES | 1063647 | U | 11/2006 |

* cited by examiner

DEVICE AND METHOD FOR THE APPLICATION OF EVAPORATION ELEMENTS AND MATERIALS TO GARMENTS AND HEAD GEAR TO REDUCE CORE BODY TEMPERATURE FOR ATHLETIC PERFORMANCE ENHANCEMENT

CROSS REFERENCE TO RELATED APPLICATIONS

This application is a continuation of U.S. application Ser. No. 18/631,386, filed Apr. 10, 2024, the entireties of this related application being incorporated herein by reference.

TECHNICAL FIELD

The inventive technology described herein is directed to an evaporative cooling device configured to be secure to one or more articles of clothing.

BACKGROUND

The personal endurance and sporting community is relentlessly focused on performance. It is known that performance can be limited by internal overheating of the body. This is known as core body temperature rise. It is vital that every aspect of performance enhancements be utilized. It is known that perspiration is the body's method of cooling. The evaporation of perspiration off/away from the body is the key function to support the cooling of the outer body temperature. In turn the cooling of the outer body temperature reduces the inner core body temperature. However, normal regulation of body temperature by evaporation of sweat is not always possible in certain climates or certain activities, such as long or intense physical exercise.

The prior art has recognized the correlation between performance degradation and increase in core body temperature. For example, as shown by Wright et al., as core body temperature increases correlates with a direct percentage drop in performance. See Wright K P Jr, Hull J T, Czeisler C A. *Relationship between alertness, performance, and body temperature in humans*. Am J Physiol. 2002; 283(6):R1370-R1377. In addition, heart rate increase is also associated with core body temperature increase. As noted by the Society of Critical Care Medicine, "increase in body temperature is associated with a linear increase in heart rate of 9.46 beats/min/° C. in female and 7.24 beats/min/° C. in male patients. These observations will help to correctly interpret heart rate values at different body temperatures and enable more accurate evaluation of other factors associated with tachycardia."

As further shown by Drust et al., although an elevated muscle temperature is expected to promote sprint performance, power output during repeated sprints was reduced by hyperthermia. The impaired performance does not seem to relate to the accumulation of recognized metabolic fatigue agents and we, therefore, suggest that it may relate to the influence of high core temperature on the function of the central nervous system. See Drust B, Rasmussen P, Mohr M, Nielsen B, Nybo L. *Elevations in core and muscle temperature impairs repeated sprint performance*. Acta Physiol Scand. 2005 February; 183(2):181-90.

In another study, nine unacclimatized university sportsmen performed a prolonged, intermittent, high-intensity shuttle running test in hot (HT) (33 degrees C., dry bulb temperature, approximately 28%, relative humidity) and moderate (MT) (17 degrees C., 63%) environmental conditions. Subjects performed 60 m of walking, a 15-m sprint, 60 m of cruising (approximately 85% V.O (2max)), and 60 m of jogging (approximately 45% V.O) (2max)) for 14.8+/−0.1 min followed by a 3-min rest, repeated until volitional exhaustion. The hot trial was performed first followed, 14 days later, by the moderate trial. During exercise subjects drank water and libitum. Subjects ran almost twice as far in the moderate as in the hot trial (HT 11216+/−1411, MT 21644+/−1629, m, $p<0.01$), and the decline in average 15-m sprint performance was greater in the heat (HT. 0.17+/−0.05, MT. 0.09+/−0.03, s. $p<0.05$).

Average heart rates, blood lactate and glucose, and plasma adrenaline and noradrenaline concentrations were greater in the HT (main effect trial, $p<0.01$), as were serum cortisol concentration (main effect trial $p<0.05$, n=5) and muscle temperature (HT exhaustion vs. same time point in MT, 40.2+/−0.3 vs. 39.3+/−0.2, degrees C., $p<0.01$).

Peak torque during knee flexion and extension was not different pre- and post-exercise in the HT. Muscle glycogen utilization tended to be greater in the heat (HT 193.2+/−19.5, MT 143.8+/−23.9, mmol. kg dry wt (−1). $p=0.055$, n=8). In 7 out of the 8 subjects the increase in utilization was between 19 and just over 200% greater in the HT. Glycogen remaining in the muscle at exhaustion was greater in the hot than moderate trial (HT 207.4+/−34.3, MT 126.5+/−46.8, mmol. kg dry wt (−1), $p<0.01$, n=8).

Rectal temperature (T (rec)) was higher in the HT at exhaustion than at the same point in time in the moderate trial (HT, 39.60+/−0.15 vs. MT 38.75+/−0.10. degrees C., interaction trial-time, $p<0.01$). There was a very strong negative relationship between rate of rise in T (rec) and distance completed in the HT (HT $r=-0.90$, $p<0.01$, MT $r=-0.76$, $p<0.05$).

Thus, the earlier onset of exhaustion during prolonged intermittent shuttle running in the heat is associated with hyperthermia. However, while muscle glycogen utilization may be elevated by heat stress, low whole muscle glycogen concentrations would not seem to be the cause of this earlier exhaustion. See Morris J G, Nevill M E, Boobis L H, Macdonald I A, Williams C. *Muscle metabolism, temperature, and function during prolonged, intermittent, high-intensity running in air temperatures of* 33 *degrees and* 17 *degrees C*. Int J Sports Med. 2005 December; 26(10):805-14.

As can be seen, there exists a strong correlation between regulation of core body temperature and athletic performance. Moreover, this need to regulated core body temperature can be applied to a variety of non-athletic settings, such as individuals working or living in high-temperature climates. As such, there is a long-felt need for a device that enables enhanced core body temperature regulation of persons and athletes that are involved in any physical exercise, for example cycling and running events in any ambient temperature, but particularly in warm to hot humid environmental atmospheric conditions. The present invention assists the reduction, maintenance and stabilization of a user's core body temperature. Increasing the body's ability to support the evaporation of perspiration surface area and to inherently support sweat evaporation appropriately will support core body temperature reduction and increase athletic performance and user comfort.

SUMMARY OF THE INVENTION

In one aspect, the current invention details the use of a device configured to regulate body temperature that can be incorporated and/or applied to one or more garments designed for indoor or outdoor use. In general, the utilization of air movement across a designed Perspiration Evaporation Device (PED) surface as described herein can result in a decrease of temperature of the surface the device is attached to which is subsequently transferred to the core body in addition the current disclosure design which will assist the evaporation of the bodies sweat.

In another aspect, the present invention generally relates to systems and methods for the use and incorporation of a (PED) constructed out of various materials that can be coupled to a garment, or other accessory such as a hat or headgear and the like. Airflow across the PED causes an increase in evaporation and thereby a reduction of outer body temperature and subsequent reduction of core body temperature as applied to clothing, in particular athletic clothing and other accessories. The application of the PED to non-athletic clothing and accessories is also encompassed by this disclosure. In a preferred embodiment, the present invention results in the increase of perspiration evaporation and hence the improved evaporation of perspiration and as a result, core body temperature reduction and improved performance.

In another aspect, the present invention the application of a device, system and method based on a PED device designed for the application to increase the evaporation of sweat from the body and the application of the design can reduce the core body temperature. For example, by applying the present device and application theory of the PED to garments that are worn in exercise or competition conditions the outer body's temperature can be reduced and, as a result, the internal core body temperature is reduced by increasing evaporation of sweat away from the body. In one aspect, the PED device disclosed herein can be secured to helmets, headgear and any application of this design material for core body temperature reduction.

In another aspect the current PED device can be sewed into or onto or otherwise secured a garment with material. For example, device material can be adhered to the garment using a thermal adhesive, such as thermal glue. Evaporation device material components can be applied in any manner to the garment in the current invention.

In another aspect, the current invention vents perspiration away from the wearer's body and can be made of any material to suit the form factor needed. Application of commonly available materials used for this design and the use of material design principles that can be applied to, but are not limited to, the cooling purposes of garments as expressed in this application and disclosure. Materials such as plastic, nanoporous polyethylene, metal alloy, or composites can be used to form the PED of the invention. The placement and application of this PED device design material can be on any area or section of the garment to the advantage of core body reduction that is required.

This summary is not a definitive description of the application and description, system and method of this invention. The application of this design PED material in the current invention could be determined by the expected ambient temperature and to the degree of body temperature reduction/normalization that is needed or calculated. This application could also be adjusted to best suit the speed expected of the individuals wearing the garment and/or the ambient temperature.

DETAILED DESCRIPTION OF INVENTION

The present invention takes advantage of the heat transfer that is a result of air movement across a device that is designed to increase the evaporation of perspiration based on air movement to draw sweat up and away from the wearer's body. This action is based on the Bernoulli principle that states Bernoulli's principle is a key concept in fluid dynamics that relates pressure, speed and height. Bernoulli's principle states that an increase in the speed of a fluid occurs simultaneously with a decrease in static pressure or the fluid's potential energy.

Figure 1:
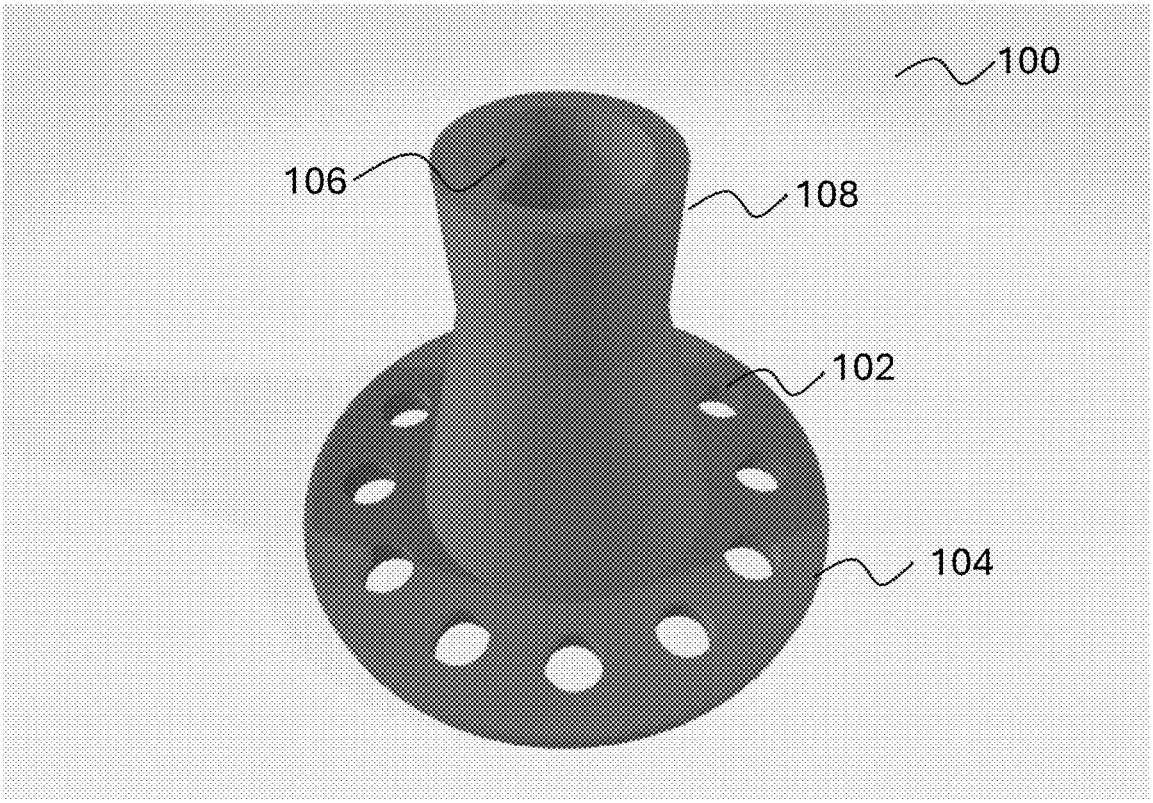
FIG. 1. shows a front perspective view of an exemplary Perspiration Evaporation Device (PED) in open embodiment thereof.

One aspect of the invention is described in FIG. 1, which shows a front perspective view of an exemplary Perspiration Evaporation Device (PED) 100, attachment holes 102, base of Perspiration Evaporation Device (PED) 104, outside of evaporation column 108, inside of column of Perspiration Evaporation Device (PED), in open embodiment thereof.

Figure 2:
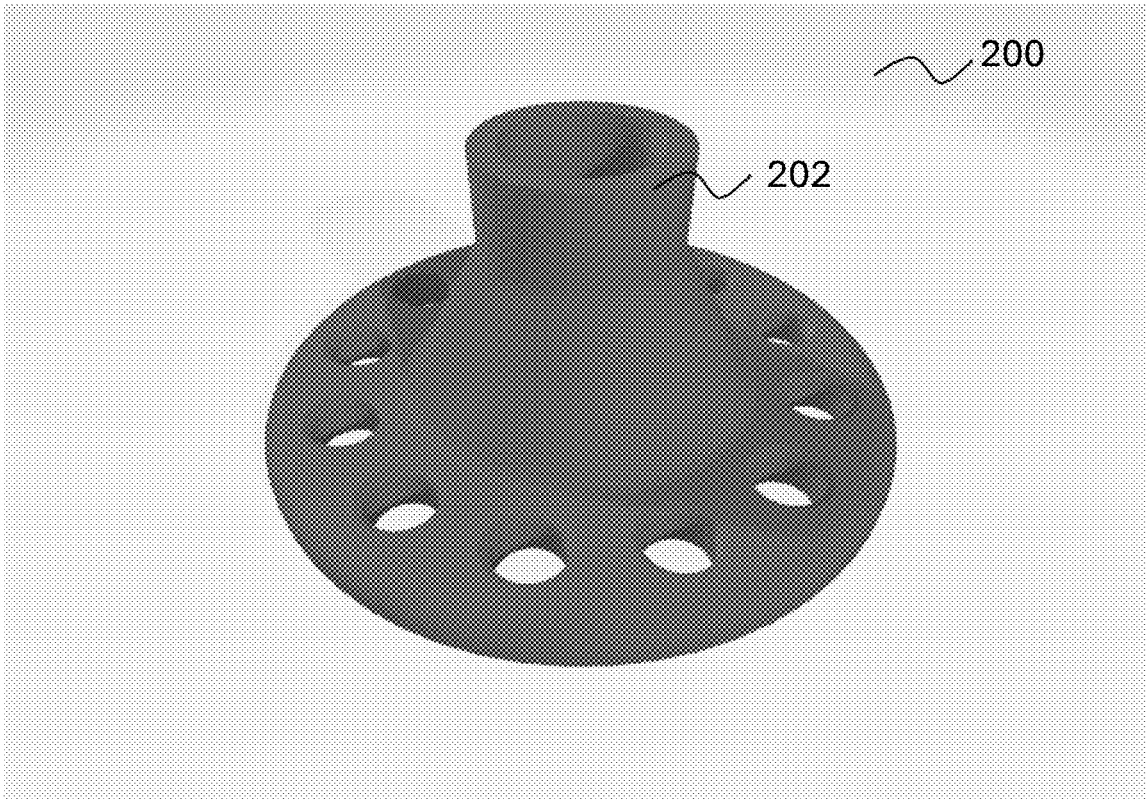
FIG. 2. shows a front perspective view of an exemplary Perspiration Evaporation Device (PED) having an evaporative column having a variable shape and internal channel length in open embodiment thereof.

Another aspect of the invention is described in FIG. 2, which shows a front perspective view of an exemplary Perspiration Evaporation Device (PED) 200 having an evaporative column having a variable shape and internal channel length 202 in open embodiment thereof.

Figure 3:
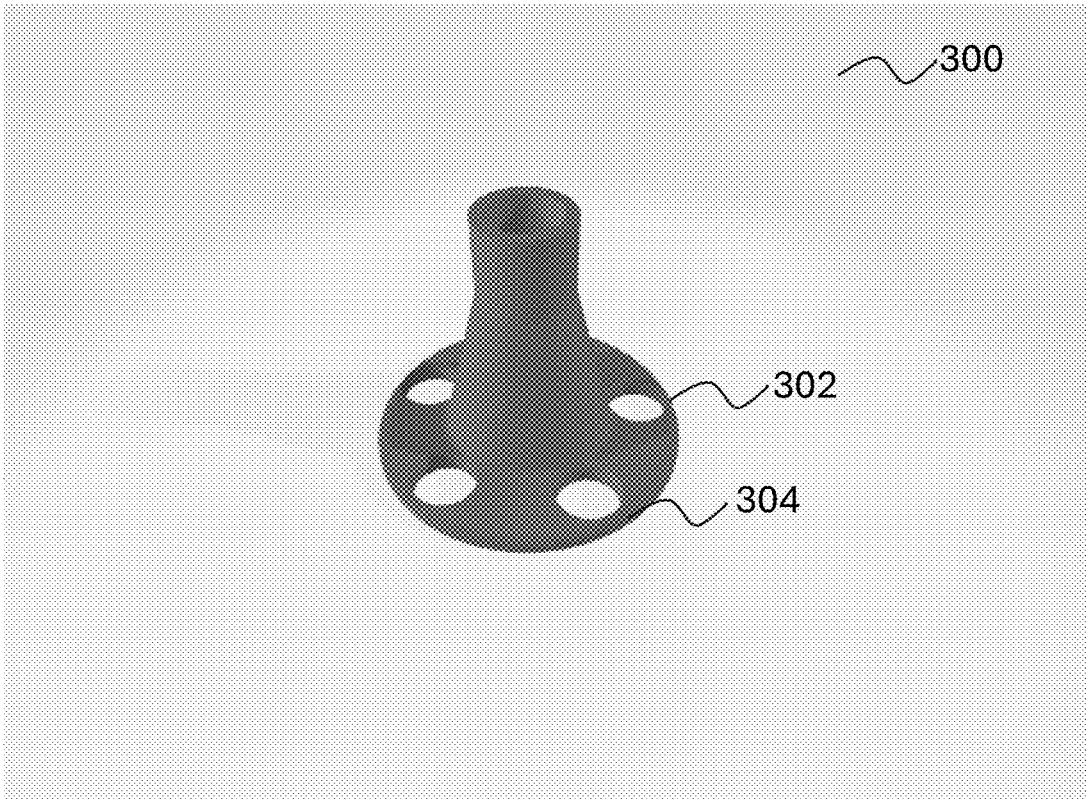
FIG. 3. shows a front perspective view of another exemplary Perspiration Evaporation Device (PED) having an evaporative column having a variable shape and internal channel length a swell as multiple attachment holes or apertures positioned along the base of the device in open embodiment thereof.

Another aspect of the invention is described in FIG. 3, which shows a front perspective view of another exemplary Perspiration Evaporation Device (PED) 300 having an evaporative column having a variable shape and internal channel length a swell as multiple attachment holes 302 or apertures positioned along the base 304 of the device in open embodiment thereof.

Figure 4A:
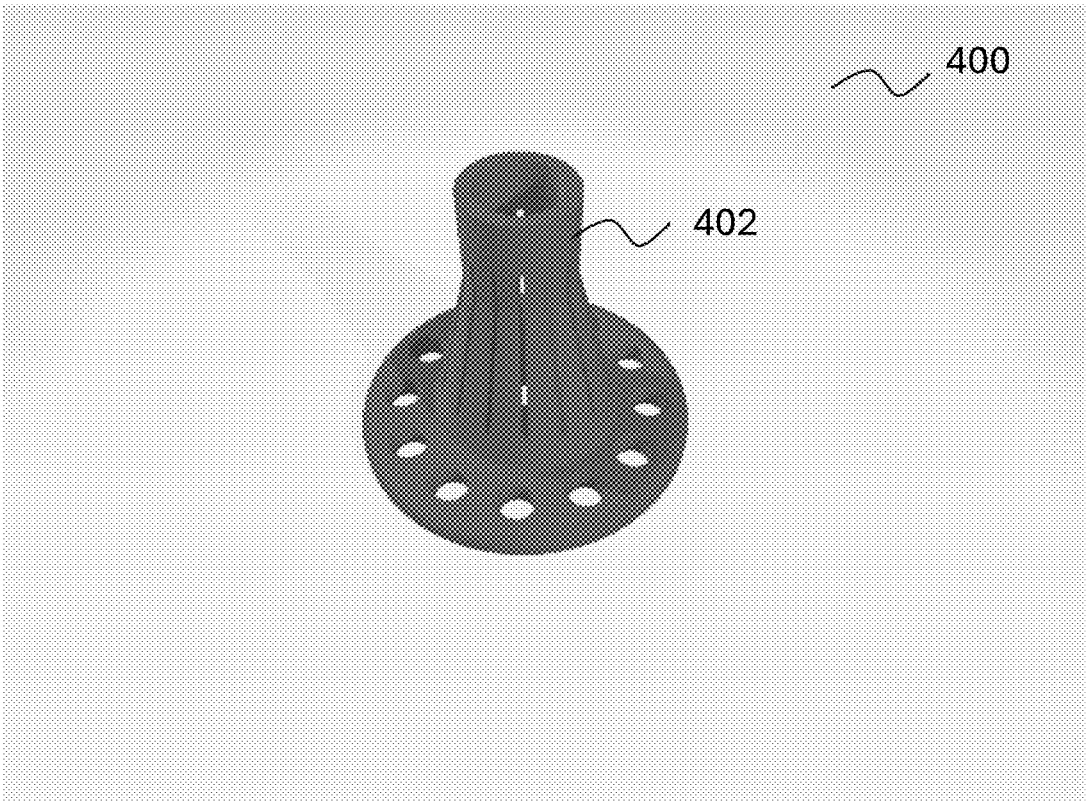
FIG. 4A. shows a front perspective view of an exemplary PED having an evaporative column having a plurality vertically positioned vents in open embodiment thereof.

Another aspect of the invention is described in FIG. 4A, which shows a front perspective view 400 of an exemplary PED having an evaporative column having a plurality vertically positioned vents 402 in open embodiment thereof.

Figure 4B:
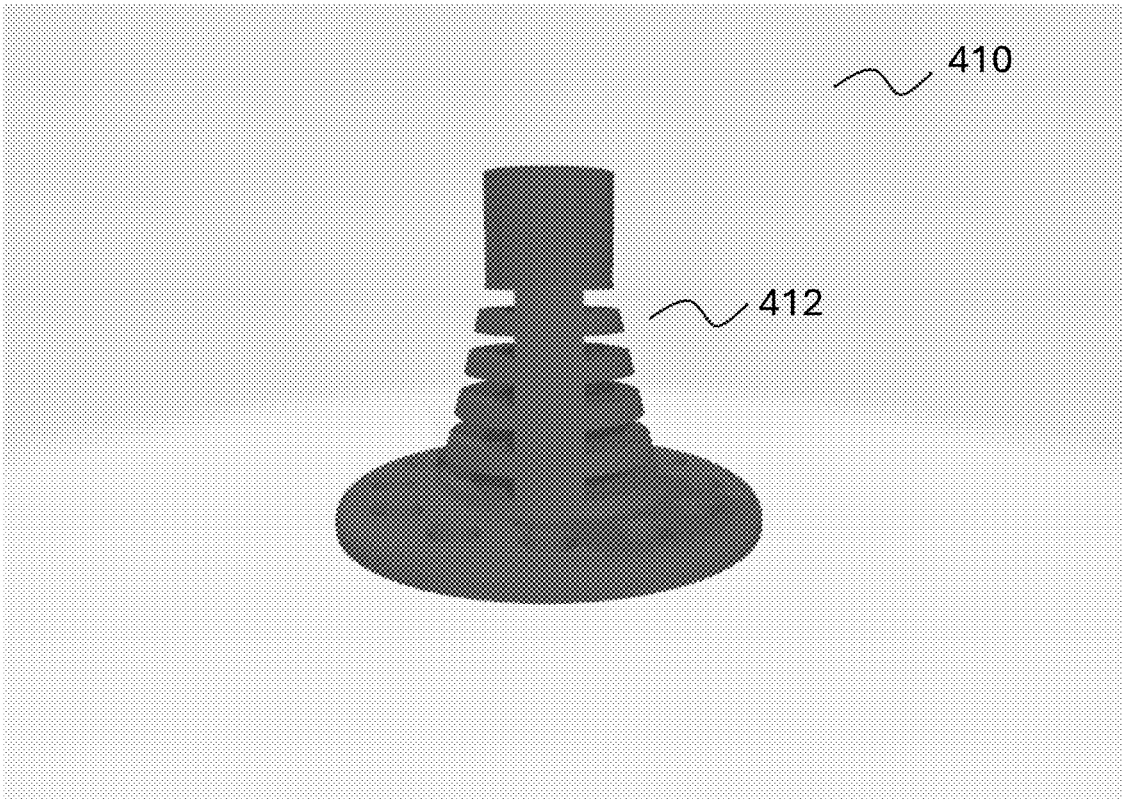
FIG. 4B. shows a front perspective view of an exemplary PED having an evaporative column having a plurality horizontally positioned vents in open embodiment thereof.

Another aspect of the invention is described in FIG. 4B, which shows a front perspective view 410 of an exemplary PED having an evaporative column having a plurality horizontally positioned vents 412 in open embodiment thereof.

Figure 5:
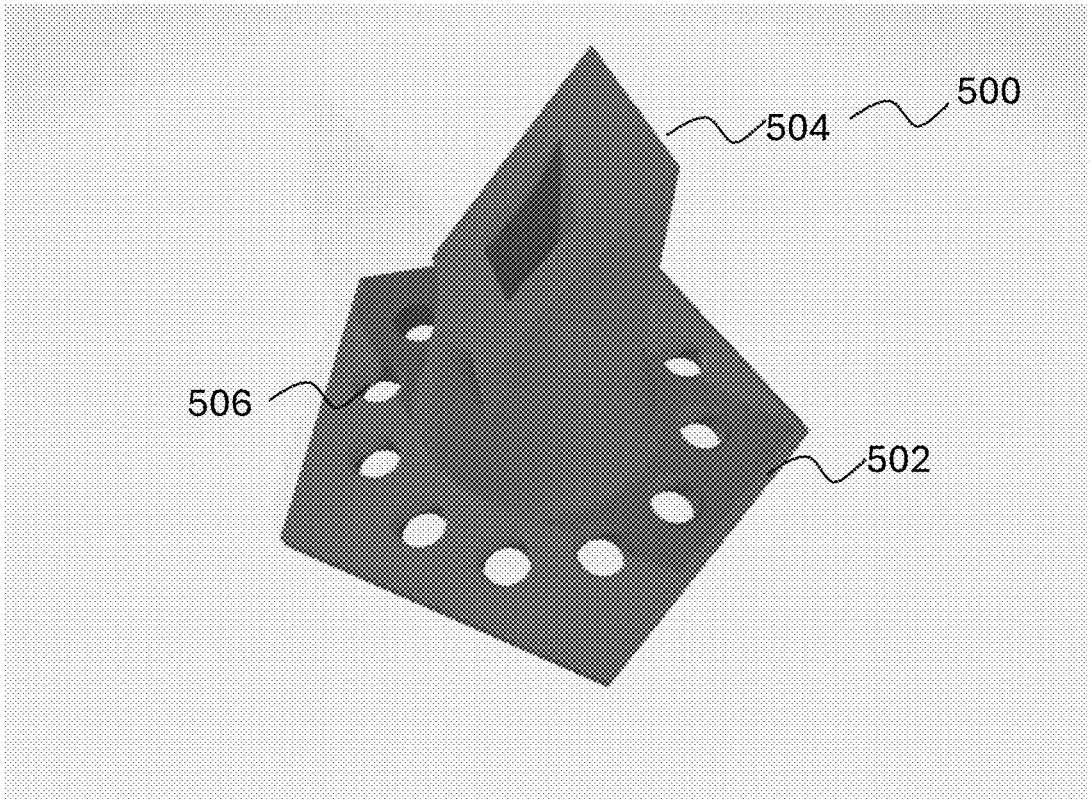
FIG. 5. shows a top perspective view of an exemplary PED having an evaporative column having an asymmetrical surface and possible shape of base in open embodiment thereof.

Another aspect of the invention is described in FIG. 5, which shows a top perspective view 500 of an exemplary PED having an evaporative column having an asymmetrical surface 504 and possible shape of base 502 and various number of attachment holes 506 in open embodiment thereof.

Figure 6:
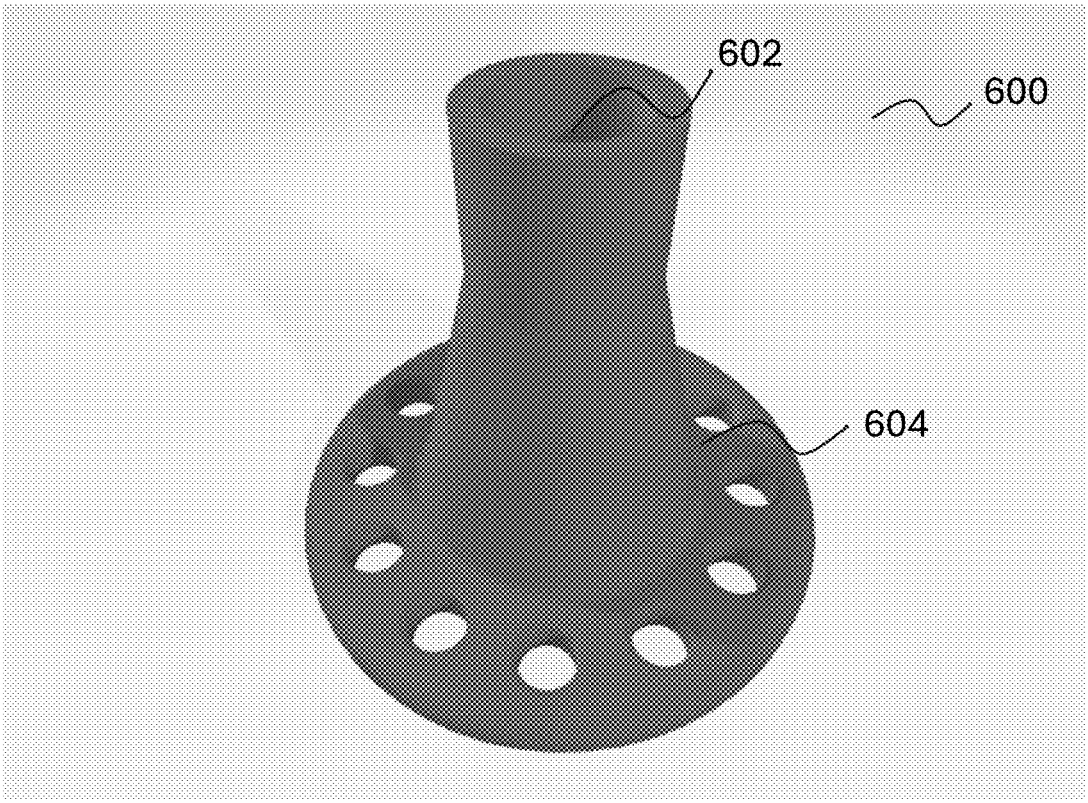
FIG. 6. shows a front perspective view of an exemplary PED having an evaporative column having a flared proximal portion in open embodiment thereof.

Another aspect of the invention is described in FIG. 6, which shows a front perspective view of an exemplary PED 600 having an evaporative column 602 having a flared proximal portion 604 in open embodiment thereof.

Figure 7:
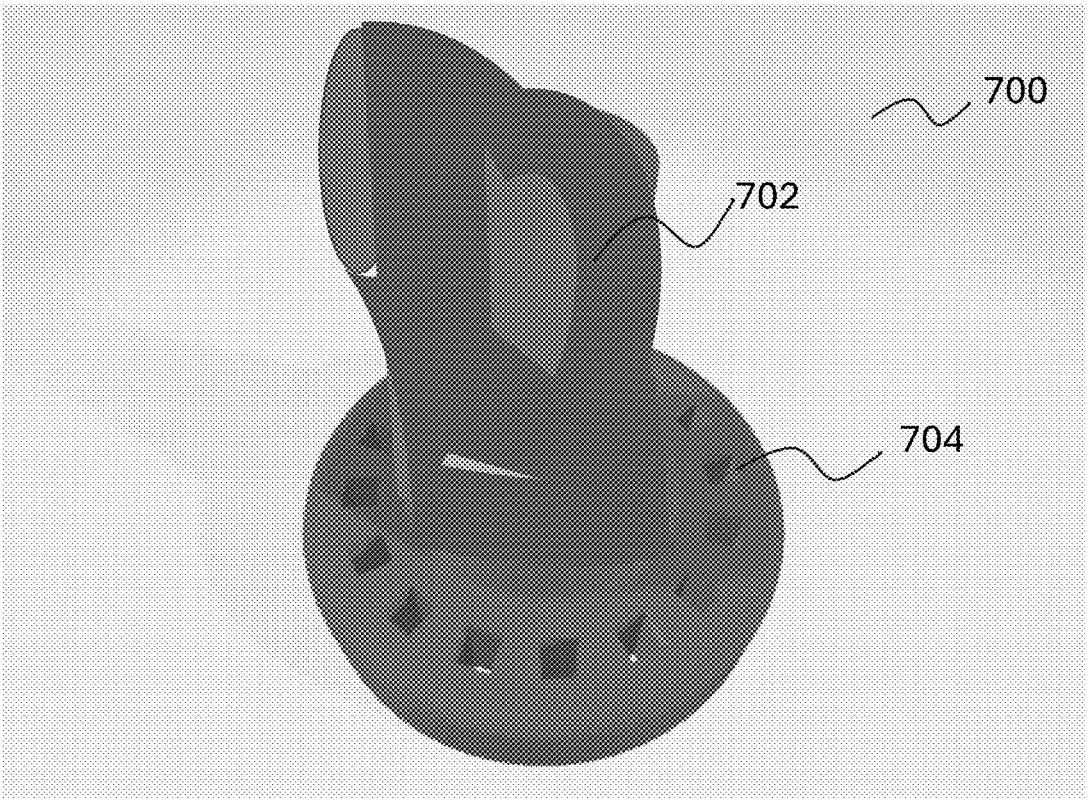
FIG. 7. shows a front perspective view of an exemplary PED having an evaporative column having a curved profile column in open embodiment thereof.

Another aspect of the invention is described in FIG. 7, which shows a front perspective view of an exemplary PED 700 having an evaporative column having a curved profile column 702 and shows an alternative shape attachment holes 704 in open embodiment thereof.

Figure 8:
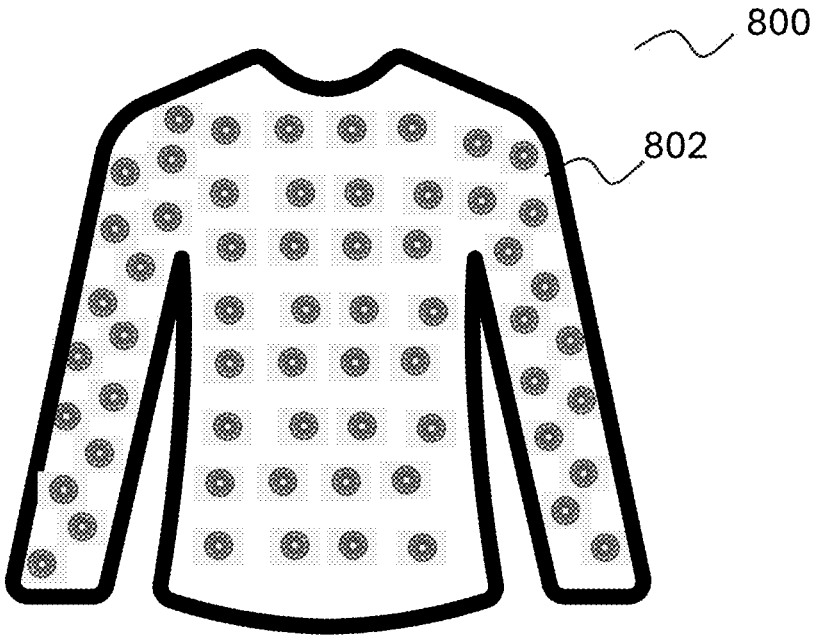
FIG. 8. shows a PED system including a plurality of PED devices secure to an exemplary long-sleeve front garment in one embodiment thereof.

Another aspect of the invention is described in FIG. 8, which shows a front perspective view of an exemplary PED 800 system including a plurality of PED devices secure to an exemplary front of long sleeve garment 802 in one embodiment thereof.

Figure 9:
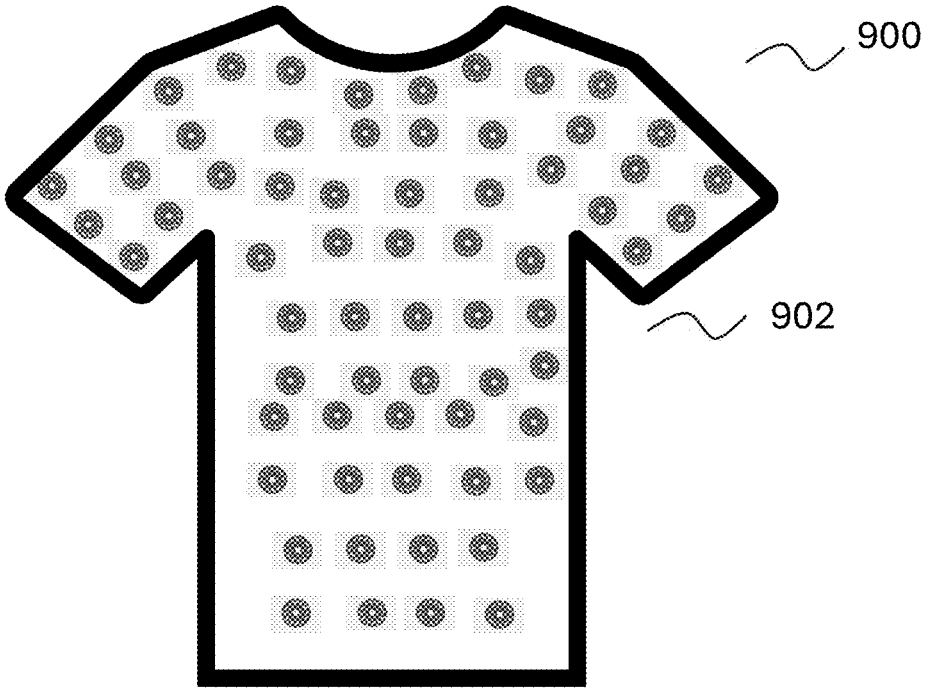
FIG. 9. shows a PED system including a plurality of PED devices secured to an exemplary short-sleeve front garment in one embodiment thereof.

Another aspect of the invention is described in FIG. 9, which shows a front perspective view of an exemplary PED 900 system including a plurality of PED devices secure to an exemplary front of short sleeve garment 902 in one embodiment thereof.

Figure 10:
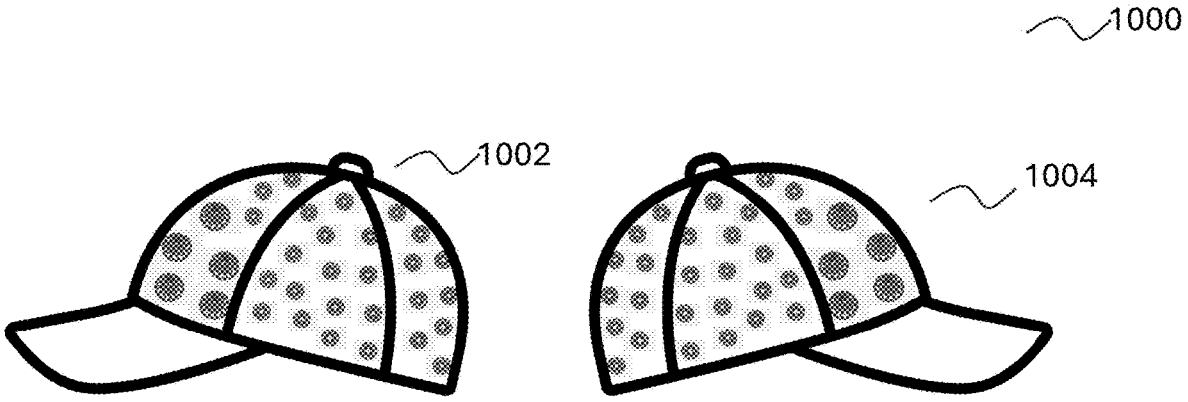
FIG. 10. shows a PED system including a plurality of PED devices secured to an exemplary head cap left and right in one embodiment thereof.

Another aspect of the invention is described in FIG. 10, which shows a PED system 1000 including a plurality of PED devices secure to an exemplary head cap left 1002 and right 1004 in one embodiment thereof.

As shown generally in FIG. 1, the present invention describes perspiration evaporation device (PED) (100). In a preferred embodiment, a PED (100) of the invention can include a base (104) that can further be configured to be secured to, or otherwise coupled to a garment (800, 900, 1000) or other accessory such as a helmet, or other head gear. In one embodiment, the base (104) can include one or a plurality of apertures (102) configured to allow the base (104) to be secured to a garment (800, 900, 1000), for example by a traditional threaded coupling mechanism. In alternative embodiments, the base (104) can be manufactured into the garment (800, 900, 1000), such as being positioned between two separate fabric components and further sewn into place. In still further embodiments, the base (104) can be secured to the surface of a garment (800, 900, 1000), such as through an adhesive like a thermal glue or other appreciate adhesive material.

The present invention describes a perspiration evaporation device (PED) (100) having an evaporative column (108). Again, as shown generally in FIG. 1, the evaporative column (108) can include an internal channel (106) that when secured to a garment (800, 900, 1000) can be in a position approximate to a user's skin. In this preferred embodiment, as air passes over the internal channel (106) the internal air pressure within the evaporative column (108) is reduced causing evaporated moisture from a user's skin to be drawn up the internal channel (106) and away from the skin and ultimately expelled from the internal channel (106). As shown in FIGS. 1-10, the dimensions and length of the evaporative column (108), as well as the diameter of the internal channel (106) can vary depending on the application and a user's preference.

In another embodiment, the present invention describes a perspiration evaporation device (PED) (100) having an evaporative column (108) further including one or more vents (402, 412). As shown generally in the FIG. 1, the evaporative column (108) can include an internal channel (106) that when secured to a garment (800, 900, 1000) can be in a position approximate to a user's skin that further includes one or more vents (402, 412, 110) that are in fluid communication with the internal channel (106). Notably, as shown in FIGS. 4A-B, the vents (402,412) of the invention can be positioned horizontally 412 and/or vertically 402. In this preferred embodiment, as air passes over the internal channel (106) the internal air pressure within the evaporative column (108) is reduced causing evaporated moisture from a user's skin to be drawn up the internal channel (106) and away from the skin and ultimately expelled through the one or more vent (402, 412) or through the distal aperture of the channel (106).

In one embodiment, the evaporative column (108) and base (104) form an integral component. While in alternative embodiments, the evaporative column (108) can be detached, and re-attached to a base (104) that is adhered to the garment (800, 900, 1000). In this configuration, a user can customize the use of the PED of the invention by replacing, changing, adding, or reducing the number, type or placement of one or more PEDs adhered to the garment through their respective base (104) components. In some instances, the evaporative column (108) can be secured to the base (104) through a coupler (not shown), such as a twist lock, a slide lock, a catch lock or other similar coupling device. In a preferred embodiment, the garment (800, 900, 1000) can include an athletic garment, which, as noted above, can be customized based on the type, number and placement of one or more PEDs (100) of the invention, which can vary from activity-to-activity, or may be sport specific. Moreover, the material base (104) and/or evaporative column (108) of the invention can be made of a variety of materials, including but not limited to: plastic, thermoplastic, nanoporous polyethylene, metal, alloy, a porous material, or a composite material.

In another embodiment, the base (104) of the device can have a course surface that can be configured to catch the threads of the surface of a garment or accessory to aid in its attachment. In one example, this course surface (not shown) can be integral to the device, while in other embodiments it can be a separable component, such as a Velcro® strip that secured to the (base (104) of the device.

The evaporative column (108) of the invention generally includes a longitudinal configuration. However, in certain embodiments, the proximal portion of the column (108) can be flared, while in alternative embodiments the distal portion of the column (108) can include an asymmetrical surface (504). In each instance, the configurations are such that as air passes over the internal channel (106) the internal air pressure within the evaporative column (108) is reduced causing evaporated moisture from a user's skin to be drawn up the internal channel (106) and away from the skin and ultimately expelled or through the distal aperture of the asymmetrical surface (504).

Naturally, all embodiments discussed herein are merely illustrative and should not be construed to limit the scope of the inventive technology consistent with the broader inventive principles disclosed. As may be easily understood from the foregoing, the basic concepts of the present inventive technology may be embodied in a variety of ways. It generally involves systems, methods, techniques as well as devices to accomplish a perspiration evaporation device (PED) and method of using the same. In this application, the methods and apparatus for the aforementioned systems are disclosed as part of the results shown to be achieved by the various devices described and as steps that are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

While the invention has been described in connection with one or more preferred embodiment, it is not intended to limit the scope of the invention to the particular form set forth, but on the contrary, it is intended to cover such alternatives, modifications, and equivalents as may be included within the spirit and scope of the invention as defined by the statements of invention. As can be easily understood from the foregoing, the basic concepts of the present invention may be embodied in a variety of ways. It involves both techniques as well as devices to accomplish the appropriate system. In this application, the techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention may be described in some instances in method-oriented terminology, each element of the claims corresponds to a device and vice versa. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting any claims. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element that causes that action. Similarly, each physical element disclosed should be understood to encompass a disclosure of the action which that physical element facilitates. Regarding this last aspect, as but one example, the disclosure of a "coupler" should be understood to encompass disclosure of the act of "coupling"—whether explicitly discussed or not—and, conversely, were there effectively disclosure of the act of "coupling", such a disclosure should be understood to encompass disclosure of a "coupling method and/or technique, and/or device." Such changes and alternative terms are to be understood to be explicitly included in the description.

Thus, the applicant(s) should be understood to have support to claim and make a statement of invention to at least: i) each of the methods and/or apparatus for providing an perspiration evaporation device (PED) as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, xii) each potentially dependent claim or concept as a dependency on each and every one of the independent claims or concepts presented, and xiii) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in *Hakim v. Cannon Avent Group, PLC,* 479 F.3d 1313 (Fed. Cir 2007), or the like are expressly not intended in this or any subsequent related matter. In addition, support should be understood to exist to the degree required under new matter laws—including but not limited to European Patent Convention Article 123 (2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. It should be understood that this application also provides support for any combination of elements in the claims and even incorporates any desired proper antecedent basis for certain claim combinations such as with combinations of method, apparatus, process, and the like claims.

Any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon. The inventive subject matter is to include, but certainly not be limited as, a system substantially as herein described with reference to any one or more of the Figures and Description (including the following: for example, the process according to any claims and further comprising any of the steps as shown in any Figures, separately, in any combination or permutation).

Finally, Applicant reserves the right to seek additional design patent protection over the claimed invention; such that the drawings are fully enabled so as to allow one of ordinary skill in the art to know that the claimed design was in Applicant's possession at the time of filing. As such, it should be noted that any broken lines are to be included for the purpose of illustrating environmental matter and form no part of the claimed design should such become necessary.

What is claimed is:

1. A perspiration evaporation device (PED) comprising:

a garment having an evaporative column having an internal channel secured to a base, wherein the internal channel is in fluid communication with a user's skin;

wherein as air passes over the internal channel the internal air pressure within the evaporative column is reduced causing evaporated moisture from the user's skin to be drawn up the internal channel and away from the skin and expelled from the internal channel, wherein the PED comprises an integral device formed by the fabric of garment.

2. The device of claim 1, wherein said garment is selected from: an athletic garment, a shirt, pants, shorts, athletic wear, a hat, a helmet, head-gear, a wearable sleeve, a headband, a racing suit, or a garment accessory.

3. The device of claim 1, wherein said evaporative column is curved.

4. The device of claim 1, wherein said evaporative column comprises one or more vents.

5. The device of claim 4, wherein said one or more vents comprise one or more horizontal vents, one or more vertical vents, or a combination of the same.

6. The device of claim 4, wherein said evaporative column comprises a flared proximal portion.

7. The device of claim 4, wherein said evaporative column comprises an asymmetrical surface at its distal end.

8. The device of claim 1, wherein the shape, size, diameter, or length of the evaporative column and internal channel are calibrated based on the expected ambient temperature where the device will be used.

9. A perspiration evaporation device (PED) comprising an evaporative column having an internal channel, wherein as air passes over the internal channel the internal air pressure within the evaporative column is reduced causing evaporated moisture from a user's skin to be drawn up the internal channel and away from the skin and expelled from the internal channel, wherein the PED comprises an integral device formed by the fabric of garment.

10. The device of claim 9, wherein said evaporative column comprises one or more vents.

11. The device of claim 9, wherein said evaporative column comprises an asymmetrical surface.

12. A perspiration evaporation device (PED) comprising an evaporative column having an internal channel and one or more vents secured to a garment, wherein as air passes over the internal channel the internal air pressure within the evaporative column is reduced causing evaporated moisture from a user's skin to be drawn up the internal channel and away from the skin and expelled from the internal channel or vents of the column, wherein the PED comprises an integral device formed by the fabric of garment.

13. The PED device of claim 12, wherein said evaporative column comprises an asymmetrical surface.

14. The PED device of claim 12, wherein the evaporative column is curved.

* * * * *